United States Patent [19]

Sato

[11] 4,355,442

[45] Oct. 26, 1982

[54] CONNECTING DEVICE FOR AUTOMOBILE SEAT BELT

[75] Inventor: Yoshimi Sato, Yokohama, Japan

[73] Assignee: Nissan Motor Co., Ltd., Yokohama, Japan

[21] Appl. No.: 199,849

[22] Filed: Oct. 23, 1980

[30] Foreign Application Priority Data

Oct. 31, 1979 [JP] Japan ..... 54-150798[U]

[51] Int. Cl.[3] ..... A44B 11/25

[52] U.S. Cl. ..... 24/230 AL; 24/230 AK

[58] Field of Search ..... 24/230 AL, 230 A, 230 AS, 24/230 AT, 230 AP, 230 AK

[56] References Cited

U.S. PATENT DOCUMENTS

| | | | |
|---|---|---|---|
| 3,168,770 | 2/1965 | John, Jr. et l. | 24/230 AS |
| 3,201,840 | 8/1965 | Jantzen | 24/230 AC |
| 3,228,081 | 1/1966 | Boreck | 24/230 A |
| 3,877,115 | 4/1970 | Quinding et al. | 24/230 AL |
| 4,181,832 | 1/1980 | Ueda | 24/230 AL |
| 4,208,771 | 6/1980 | Biller | 24/230 AL |

FOREIGN PATENT DOCUMENTS

| | | | |
|---|---|---|---|
| 2160089 | 6/1972 | Fed. Rep. of Germany | 24/230 AL |

*Primary Examiner*—Paul J. Hirsch

*Attorney, Agent, or Firm*—Lane, Aitken, Kice & Kananen

[57] ABSTRACT

A connecting device for an automobile seat belt including a tag, and a buckle comprising a base and a slider block slidably fitted with each other. The base comprises at least two latches slidable in directions substantially at right angles to the direction of insertion of the tang and urged away from each other by means of a spring fixed at the center of the base and integrally constructed with a spring forcing the tang out of the buckle when the former is released from the latter. The slide block is provided with a guide hole engaging the latches of the base and having guides for moving the latches toward each other in response to a movement of the slider block. The tang has a pair of guides for moving the latches toward each other in response to insertion of the tang into the buckle and a pair of anchoring portions adjoining the pair of guides for the latches. The device including the buckle and tang is lengthwise shorten and compactly constructed, which is particularly advantageous for a passive seat belt.

7 Claims, 11 Drawing Figures

CONNECTING DEVICE FOR AUTOMOBILE SEAT BELT

BACKGROUND OF THE INVENTION

1. Field of the Invention

The present invention relates to a connecting device consisting of a buckle and a tang for an automobile seat belt.

2. Description of the Prior Art

A hitherto used connecting device consisting of a buckle and a tang for an automobile seat belt is as shown in FIG. 1. The buckle comprises a base 1 and a slider block 6 combined slidably to each other. The combination of the base and slider block includes two pins 2 and 2' for anchoring the tang 7 in the base 1, springs 3 and 3' for normally urging the two pins 2 and 2' toward each other (in directions opposite to those of arrows $S_1$), springs 4 for urging in directions opposite to those of the arrows $S_1$ the slider block 6 which is actuated to release the tang 7, and a spring 5 for forcing the tang 7 out of the buckle when the pins 2 and 2' are disengaged from the tang 7. The tang 7 is formed at its insertion end with a tongue 36 moving the two pins 2 and 2' away from each other (in the directions of the arrows $S_1$). The tongue 36 includes an isosceles triangular guides 7*a* and 7*a'* and anchoring portions 7*b* and 7*b'* adjoining the guides perpendicular to the direction of the insertion of the tang 7. A belt 32 has one end connected to the base 1 and the other end 33 connected to a through aperture 7*c* of the tang 7. With this arrangement, the tang 7 is first inserted into the buckle, so that the guides 7*a* and 7*a'* of the tang 7 force the two pins 2 and 2' away from each other in the directions of the arrows $S_1$. The tang 7 is further inserted and as soon as the pins 2 and 2' reach the anchoring portions 7*b* and 7*b'*, the pins 2 and 2' move again in the directions opposite to those of the arrows $S_1$ with the aid of the springs 3 and 3' and engage the anchoring portions 7*b* and 7*b'*. When it is required to release the tang 7, the slider block 6 is urged in a direction of an arrow $S_2$ relative to the base 1, so that the two pins 2 and 2' are moved away to each other in the directions of the arrows $S_1$ by means of two triangular guide holes 8 and 8' of the slider block 6 fitting with the pins 2 and 2'. At the same time, the tang 7 is jumped out of the buckle by the action of the spring 5 urging the tang 7.

With the above arrangement of the connecting device for the seat belt, as the springs 3, 4 and 5 must be arranged in the base 1, the base 1, and hence the buckle becomes substantially long in a longitudinal direction of the belt so as to be large-sized. Accordingly, when this connecting drive is arranged for an automobile seat belt, it is difficult to obtain a space or position for the device, resulting in a limitation for laying out the safety belt. With a passive seat belt, particularly, when the connecting device is mounted on a door frame as a releasing device in an emergency, the elongated device is disadvantageous for restraining a person because the belt is positioned away from him due to the elongated buckle.

SUMMARY OF THE INVENTION

It is a primary object of the invention to provide an improved connecting device for an automobile, which is lengthwise shorten as much as possible to completely eliminate the disadvantages of the prior art.

The connecting device for an automobile according to the invention comprises a tang and a buckle including a slider block slidably fitted with a base comprising at least two latches slidable and urged away from each other by means of a spring fixed at substantially center of the base and integrally constructed with a spring forcing the tang out of the buckle when the former is released from the latter, the slider block provided with a guide hole engaging the latches of the base and having guides for moving the latches toward each other in response to a movement of the slider block, and the tang having a pair of guides for moving the latches toward each other in response to an insertion of the tang into the buckle and a pair of anchoring portions adjoining the pair of guides for the latches.

The invention will be more fully understood by referring to the following detailed specification and claims taken in connection with the appended drawings.

DETAILED DESCRIPTION OF THE PREFERRED EMBODIMENT

Figure 1:
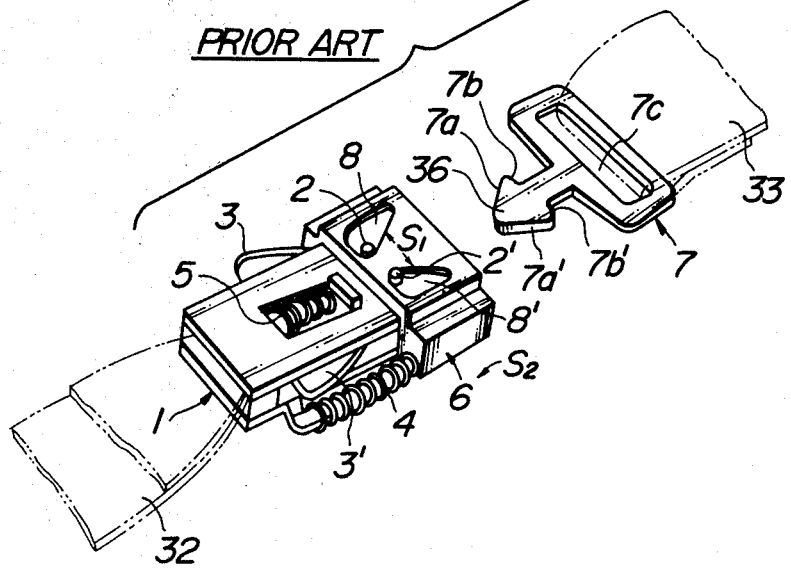
FIG. 1 PRIOR ART
FIG. 1 is a perspective view of a connecting device for a seat belt of the prior art as mentioned above.
Figure 2A:
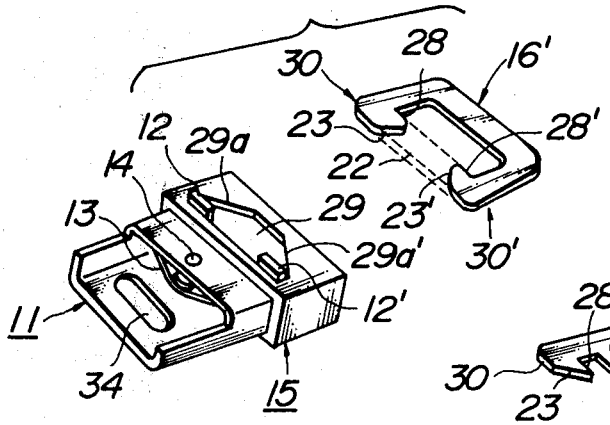
FIG. 2 is a perspective view illustrating a connecting device for a seat belt according to the invention.

Referring to FIG. 2 illustrating one embodiment of a connecting device for a seat belt according to the invention, a buckle consists of a base 11 and a slider block 15 fitted slidably with each other. An inner construction of the base 11 is shown in FIG. 3 partially broken away for this purpose. The base 11 is formed with a slit 21 on a side of insertion of tongues 30 and 30' of a tang 16 later described and perpendicular to a direction of the insertion. Latch plates or latches 12 and 12' in the form of small plates are slidably arranged in the slit 21. A spring 13 has a center portion coiled about a pin 14 upstanding at a center of the base and V-shaped legs 13*a* and 13*a'* abutting against inner edges of the latch plates 12 and 12' to urge them away from each other in directions of arrows P in FIG. 3.

Figure 4:
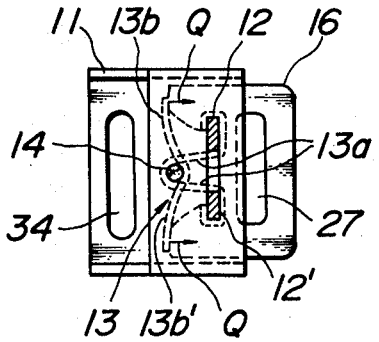
FIG. 4 is a plan view illustrating a connection of the base and a tang shown in FIG. 2.

The spring 13 is preferably formed of a wire spring by bending it and has arms 13*b* and 13*b'* extending in the same directions as that of the slit 21. As shown in FIG. 4, the arms 13*b* and 13*b'* abut against the tongues 30 and 30' and owing to their springy action serve to push the tang 16, which is moving away from the buckle, out of it. A through hole 34 is formed in the base 11 for connecting one end 32 of a seat belt.

The slider block 15 is formed with a guide hole 29 adapted to engage upper ends of the two latch plates 12 and 12' arranged on the base 11 as shown in FIG. 2. The guide hole 29 is substantially triangular in configuration and has oblique guides 29*a* and 29*a'* for moving the two latch plates 12 and 12' toward each other when the slider block 15 is moved.

The essential configuration of the tang is C-shaped as shown at 16' in FIG. 2(*a*) which is cut out at the center portion 22 of the insertion side to form tongues 30 and 30'. The tongues have guides 23 and 23' for urging outer edges of the two latch plates 12 and 12' of the buckle inwardly toward each other (in directions opposite to those of the arrows P) against forces of the springs 13*a* and 13*a'* when the tang 16' is inserted into the slider block 15, and anchoring portions 28 and 28' adjoining terminations of the guides 23 and 23' and perpendicular to the direction of the insertion. A tang 16 as shown in FIG. 2(*b*) is practically formed with a through hole 27 for connecting one end of a seat belt.

As above described, the tang according to the invention is C-shaped to form the two opposite tongues so as to provide a space 22 therebetween in which the spring 13 and pin 14 are arranged to shorten the length of the tang and buckle.

The method of using the connecting device according to the invention and the function and effect thereof will be explained hereinafter.

As the tangs 16 and 16' are the same in function, only the tang 16 will be explained. When the tang 16 is inserted into the buckle, the two latch plates 12 and 12' are moved toward each other by means of the guides 23 and 23' on the side of the insertion of the tongues of the tang 16. As soon as the tang 16 has been inserted in the base 11 through over the length of the guides in the direction of the insertion, the latch plates 12 and 12' are moved in the directions of the arrows P by the action of the spring 13 so as to be engaged with the anchoring portions 28 and 28', whereby the tang 16 is locked in the buckle. Namely, in the position shown in FIG. 4, the tongues 30 and 30' of the tang 16 abut against the arms 13*b* and 13*b'* of the spring 13 to deform the arms slightly, thereby causing a force urging the tang 16 in a direction of arrows Q.

Figure 5A:
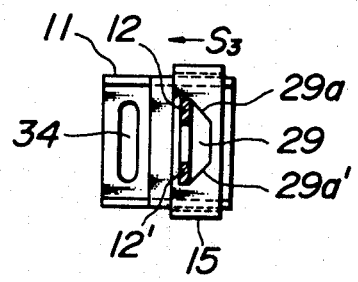
FIGS. 5*a* and 5*b* are plan views explaining the release of the tang of the device according to the invention.
Figure 5B:
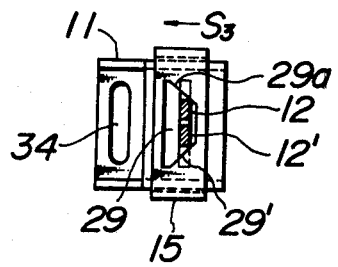

If it is required to detach the tang 16 from the buckle, the slider block 15 is first pushed in a direction of an arrow $S_3$ in FIG. 5*a*, so that the two latch plates 12 and 12' are moved toward each other by means of the guides 29*a* and 29*a'* in response to the movement of the slider block 15 as shown in FIG. 5*b*. As soon as the distance between outer edges of the two latch plates 12 and 12' becomes less than the distance between the anchoring portions 28 and 28' of the tongues 30 and 30' of the tang 16, the tang 16 is automatically jumped out the buckle by the urging force of the arms 13*b* and 13*b'* of the spring 13.

Figure 6:
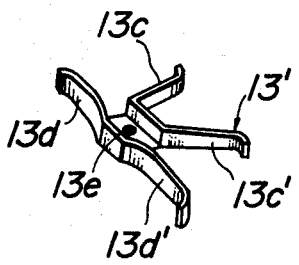
FIG. 6 is a perspective view of a modification of the spring used in the device according to the invention.

FIG. 6 illustrates a modified spring 13' corresponding to the spring 13, which is a leaf spring made of a sheet spring. The spring 13' comprises V-shaped legs 13*c* and 13*c'* engaging insides of the two latch plates 12 and 12' and arms 13*d* and 13*d'* extending in a direction the same as that of the slit 21 receiving therein the two latch plates 12 and 12', and is formed with an aperture 13*e* for securing the spring 13' to the base 11 by means of the pin 14. The spring 13' is inexpensive in comparison with the above spring 13, because the former is easy to be worked.

Figure 7A:
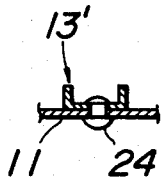
FIGS. 7*a* and 7*b* are partial sectional views showing modes of mounting of the spring shown in FIG. 6 onto the base.
Figure 7B:
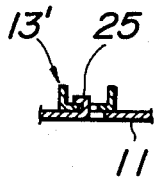

FIGS. 7*a* and 7*b* illustrate mountings of the spring 13' onto the base 11. In FIG. 7*a*, the spring 13' is secured to the base 12 by means of a rivet 24. In FIG. 7*b*, the base 11 is punched to form a finger 25 integral therewith. Both the mountings shown in FIGS. 7*a* and 7*b* are simple and inexpensive in comparison with the mounting shown in FIG. 3 utilizing the pin 14 for the spring 13.

Figure 2B:
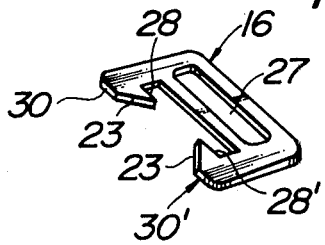
Figure 3:
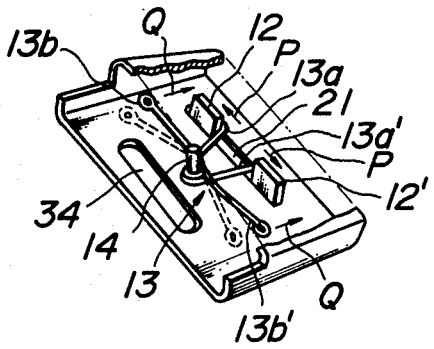
FIG. 3 is a perspective view of a base of the device shown in FIG. 2, partially broken away for illustrating an inner construction of the base.
Figure 8:
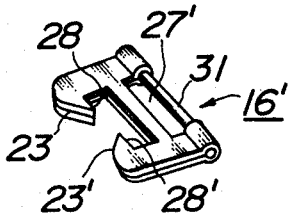
FIG. 8 is a perspective view of other embodiment of the tang used in the device according to the invention.

FIG. 8 illustrates a modification of the tang 16 shown in FIG. 2*b*. With this modification, a metal sheet is pressed or punched and folded at its center line and provided with a rod 31 to form the tang 16' having a through hole 27'. The rod 31 is effective to shorten the length of the buckle in comparison with an all flat plate and prevents a belt connected to the tang 13' from being hurt at the connected portion of the belt.

The connecting device for automobile seat belt according to the invention is constructed and used as above described and bring about following advantages.

First, the spring for urging the latch plates or latches away from each other and the spring for pushing the tang out of the buckle in releasing the tang are integrally and compactly constructed, thereby enabling the length of the base accommodating these springs and hence the length of the buckle to be greatly shortened.

Second, the tang is formed with two inwardly opposite tongues each having the guide for inwardly moving the latch and the anchoring portion adjoining the guide for the latch, thereby providing the space 22 between the tongues 30 and 30' to locate the pin 14 for securing the spring 13 or 13', whereby the tang and buckle are shortened.

Moreover, there are provided with the two tongues to ensure the more reliable fitting with the buckle in comparison with a single tongue. Particularly, as the combination of the buckle and tang is greatly shortened, a space for arranging it in an automobile can easily be obtained with a freedom for laying out a seat belt. Furthermore, the device according to the invention can be used as an emergency releasing device secured to a door frame.

While the invention has been particularly shown and described with reference to preferred embodiments thereof, it will be understood by those skilled in the art that the foregoing and other change in form and details can be made therein without departing from the spirit and scope of the invention.

What is claimed is:

1. In a connecting device for an automobile, which includes a buckle and a tang, said buckle comprising a base and a slider block slidably fitted with each other, said base comprising at least two latches urged away from each other by means of a spring and slidable in directions perpendicular to that of insertion of said tang, said spring being fixed at substantially the center of said base and integrally constructed with a spring forcing said tang out of said buckle when the former is released from the latter, said slider block provided with a guide hole engaging said latches of said base and having guides for moving said latches toward each other in response to a movement of said slider block, and said tang being made in the form of a C and having a pair of guides for moving said latches toward each other in response to an insertion of said tang into said buckle and a pair of anchoring portions adjoining said pair of guides for said latches.

2. A connecting device as set forth in claim 1, wherein said spring urging said latches away from each other has a center portion coiled about an upstanding pin at substantially the center of said base and V-shaped legs abutting against inner edges of said latches.

3. A connecting device as set forth in claim 1, wherein said spring urging said latches away from each other and said spring forcing said tang out of said buckle are integrally made of a leaf spring and comprise V-shaped legs engaging insides of said latches, and arms engaging said tang inserted in the buckle, said leaf spring formed between said legs and arms with an aperture for securing the integral leaf spring to said base.

4. A connecting device as set forth in claim 3, wherein said leaf spring is secured to said base by a rivet.

5. A connecting device as set forth in claim 3, wherein said leaf spring is secured to said base by a finger integrally formed on said base by punching.

6. A connecting device as set forth in claim 1, wherein said tang is formed with a through hole for connecting a seat belt.

7. A connecting device as set forth in claim 1, wherein said tang is made by folding a punched metal sheet and arranging a rod embraced by the sheet along a folding line to form a through hole by the rod and edges of a hole of the metal sheet.

* * * * *